US011831108B2

(12) United States Patent
Little

(10) Patent No.: US 11,831,108 B2
(45) Date of Patent: Nov. 28, 2023

(54) CABLE CONNECTOR WITH IMPROVED METALLIC SHIELD

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Terrance F Little, Fullerton, CA (US)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 63 days.

(21) Appl. No.: 17/704,002

(22) Filed: Mar. 25, 2022

(65) Prior Publication Data

US 2022/0216653 A1 Jul. 7, 2022

Related U.S. Application Data

(63) Continuation-in-part of application No. 17/459,850, filed on Aug. 27, 2021.

(60) Provisional application No. 63/166,656, filed on Mar. 26, 2021, provisional application No. 63/073,084, filed on Sep. 1, 2020.

(51) Int. Cl.

| | |
|---|---|
| ***H01R 13/00*** | (2006.01) |
| ***H01R 13/6597*** | (2011.01) |
| ***H01R 13/6591*** | (2011.01) |
| ***H01R 13/424*** | (2006.01) |

(52) U.S. Cl.
CPC ..... *H01R 13/6597* (2013.01); *H01R 13/424* (2013.01); *H01R 13/65912* (2020.08)

(58) Field of Classification Search
CPC ..... H01R 13/6597; H01R 13/65912; H01R 13/424
See application file for complete search history.

(56) References Cited

U.S. PATENT DOCUMENTS

| | | | | |
|---|---|---|---|---|
| 9,735,495 | B2 | 8/2017 | Gross | |
| 10,193,253 | B2 * | 1/2019 | Li | H01R 12/83 |
| 10,468,829 | B2 | 11/2019 | Zerebilov et al. | |
| 10,923,843 | B1 * | 2/2021 | Henry | H01R 12/714 |
| 11,125,958 | B2 * | 9/2021 | Champion | G02B 6/428 |
| 11,239,586 | B2 * | 2/2022 | Zheng | H01R 12/714 |
| 2019/0245288 | A1 | 8/2019 | Lloyd et al. | |
| 2019/0288422 | A1 * | 9/2019 | Champion | H01R 13/6587 |
| 2020/0083627 | A1 | 3/2020 | Peloza et al. | |
| 2020/0358227 | A1 | 11/2020 | Henry et al. | |
| 2020/0366017 | A1 | 11/2020 | Blackburn et al. | |

* cited by examiner

*Primary Examiner* — Phuong Chi Thi Nguyen
(74) *Attorney, Agent, or Firm* — Ming Chieh Chang

(57) ABSTRACT

A cable connector includes a contact module enclosed within a case. The contact module includes an upper part and a lower part stacked with each other. The upper part includes an upper insulator and plural upper contacts and a metallic upper shield attached upon the upper insulator. The wires include inner conductors connected to differential-pair signal contacts of the plural upper contacts. The upper shield defines a plurality of front spring fingers respectively connected to the corresponding grounding contacts and a plurality of rear spring fingers respectively connected to the braiding layers of the corresponding wires.

20 Claims, 18 Drawing Sheets

CABLE CONNECTOR WITH IMPROVED METALLIC SHIELD

CROSS REFERENCE TO RELATED APPLICATIONS

This application is a continuation-in-part of co-pending application Ser. No. 17/459,850, filed Aug. 27, 2021, and the instant application further claims the benefit of, and priority to, U.S. Provisional Patent Application No. 63/166,656, filed on Mar. 26, 2021, the contents of which are incorporated entirely herein by reference.

BACKGROUND OF THE INVENTION

1. Field of the Invention

The invention relates to a cable connector having the contacts linked with corresponding wires, and particularly to the cable connector equipped with the common metallic shield contacting both the grounding contacts and the braiding layers of the associated wires.

2. Description of Related Art

The traditional design used for connecting two subsystems respectively on two printed circuit boards, discloses a linking cable with at one end a LEC plug connector mated to a receptacle connector embedded in the ASIC, and at the other end two port IFP plug connectors mated to on one side the so-called Interposer with IFT receptacle connector, and the other side thereof further configured with two ports of QSFP-28. Anyway, a receptacle connector on one printed circuit boards and a mated plug connector to the receptacle connector at one end of the cable f are required in traditional design.

Hence, a simple mating structure of the receptacle connector and the plug connector is desired.

SUMMARY OF THE INVENTION

An object of the invention is to provide a cable connector comprising: a case and a contact module enclosed within the case and having an upper part and a lower part stacked with each other. The upper part includes: a plurality of upper contacts integrally formed within an upper insulator via insert-molding, the upper contacts comprising a plurality of differential-pair signal contacts and a plurality of grounding contacts alternately arranged with each other in a transverse direction, each of the upper contacts comprising a front mating section, a rear connecting section, and a middle retaining section therebetween in a front-to-back direction; a plurality of upper wires located behind the upper insulator, each of the upper wire comprising a pair of inner conductor, an inner insulative layer, a metallic braiding layer, and an outer insulative jacket sequentially enclosing one another, the inner conductors of the wires mechanically and electrically connected respectively to the connecting sections of the differential-pair signal contacts, the braiding layers of the wires mechanically and electrically connected respectively to the grounding bar; and a metallic upper shield secured to the upper insulator, the metallic upper shield including a plurality of front spring fingers respectively contacting corresponding grounding contacts of the upper contacts and a plurality of rear spring fingers respectively contacting the braiding layers of corresponding wires.

The upper shield further includes a plurality of dividing tabs between the front spring fingers and the rear spring fingers in the front-to-back direction for separating the neighboring differential-pair signal contacts of the upper contacts. A deflectable latch is located on a downward surface of the lower case.

DETAILED DESCRIPTION OF THE PREFERRED EMBODIMENT

Figure 1A:
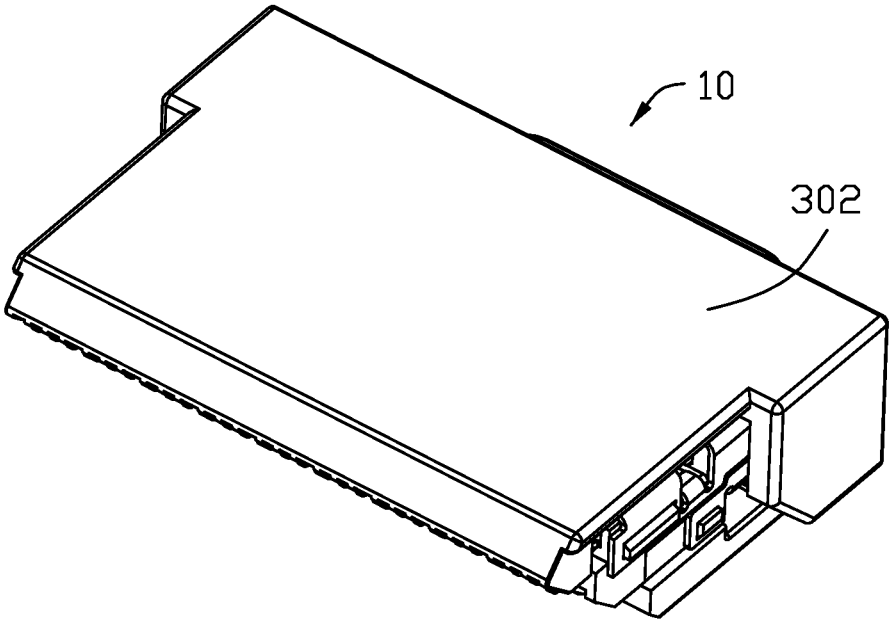
FIG. 1(A) is a perspective view of an electrical connector according to a preferred embodiment of the invention.
Figure 1B:
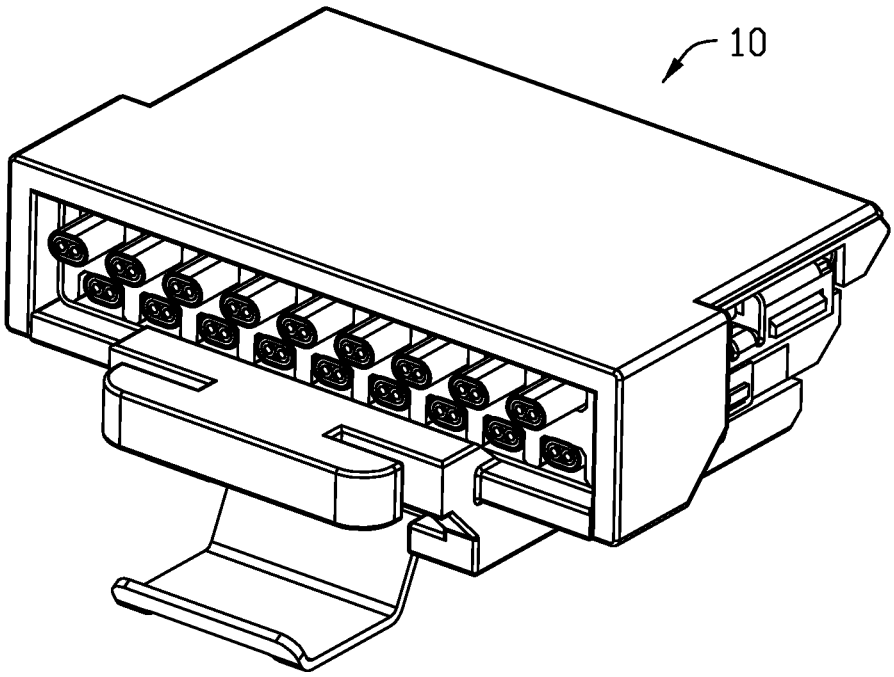
FIG. 1(B) is another perspective view of the electrical connector of FIG. 1(A)
Figure 1C:
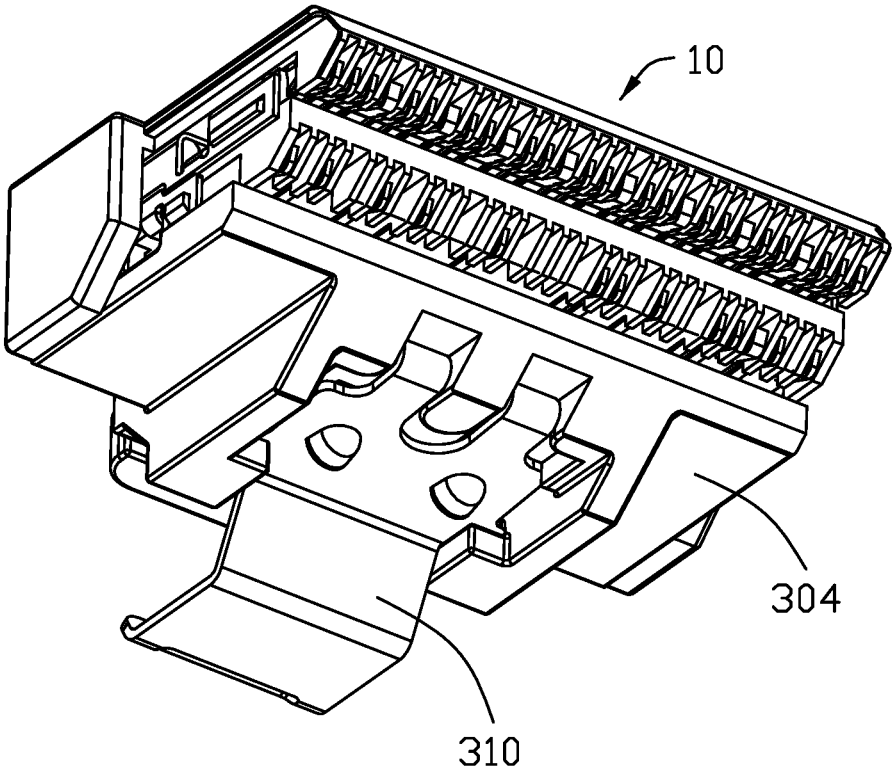
FIG. 1(C) is another perspective view of the electrical connector of FIG. 1(A)
Figure 2:
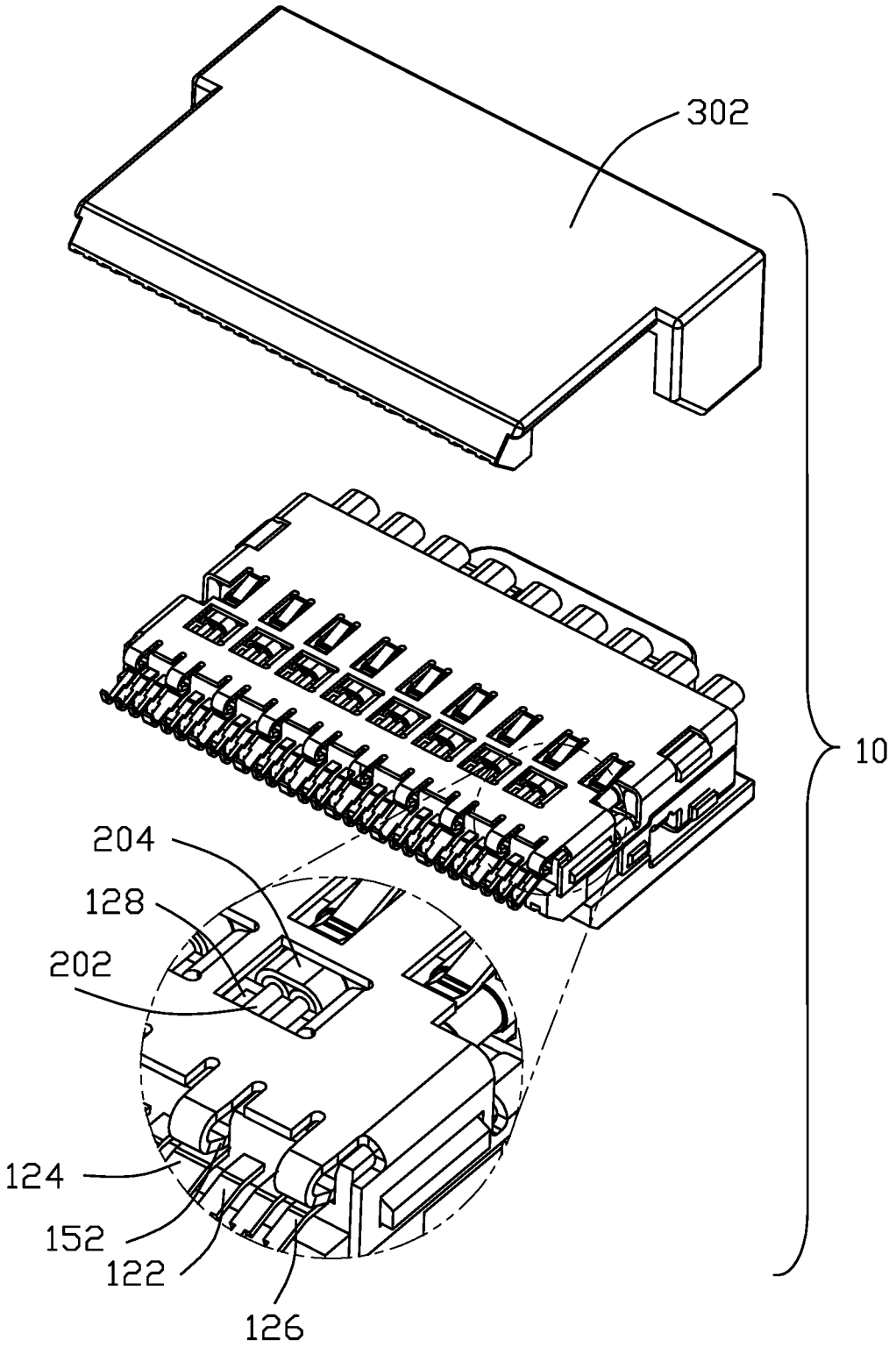
FIG. 2 is an exploded perspective view of the electrical connector of FIG. 1(A)
Figure 3:
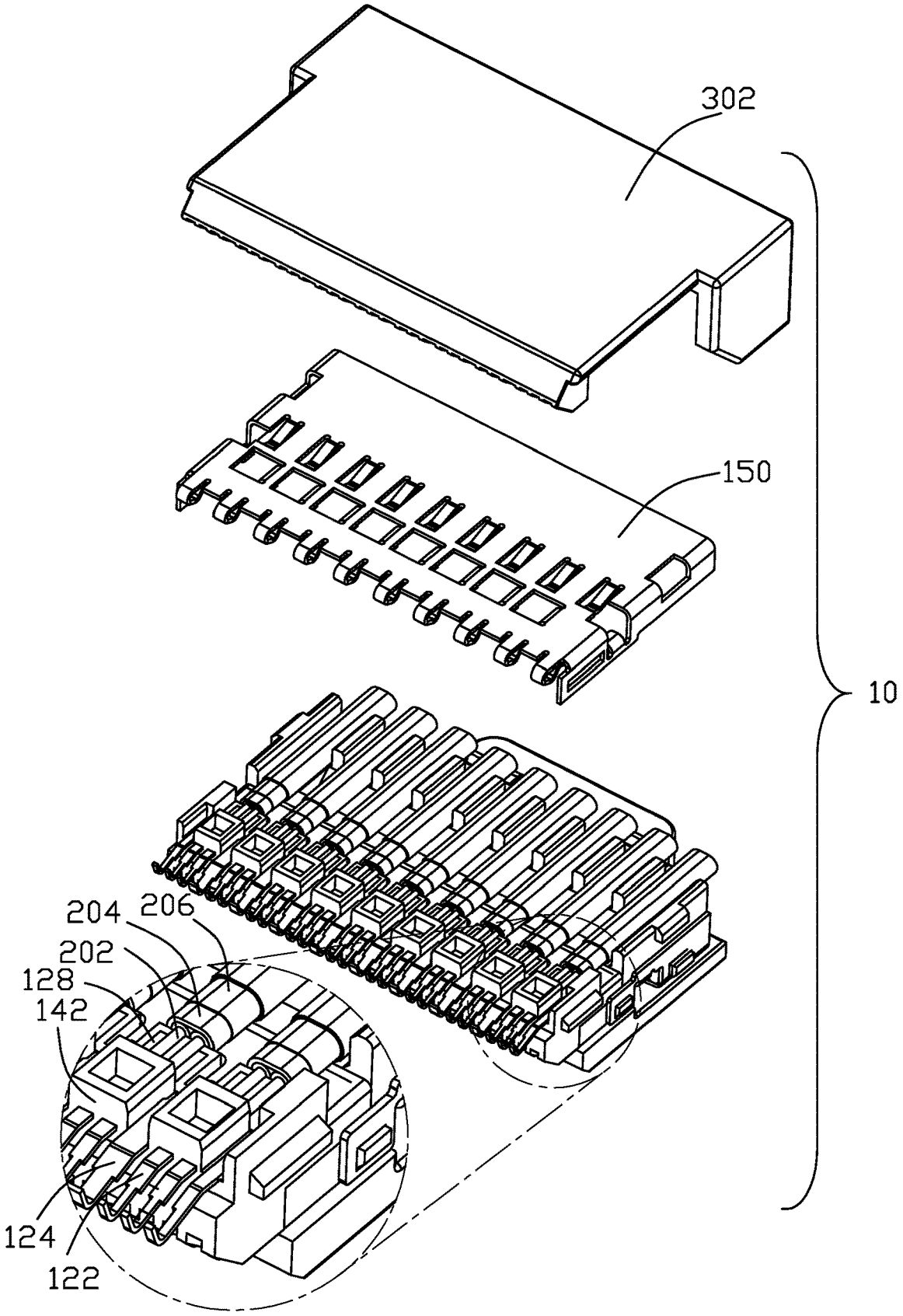
FIG. 3 is a further exploded perspective view of the electrical connector of FIG. 2.
Figure 4A:
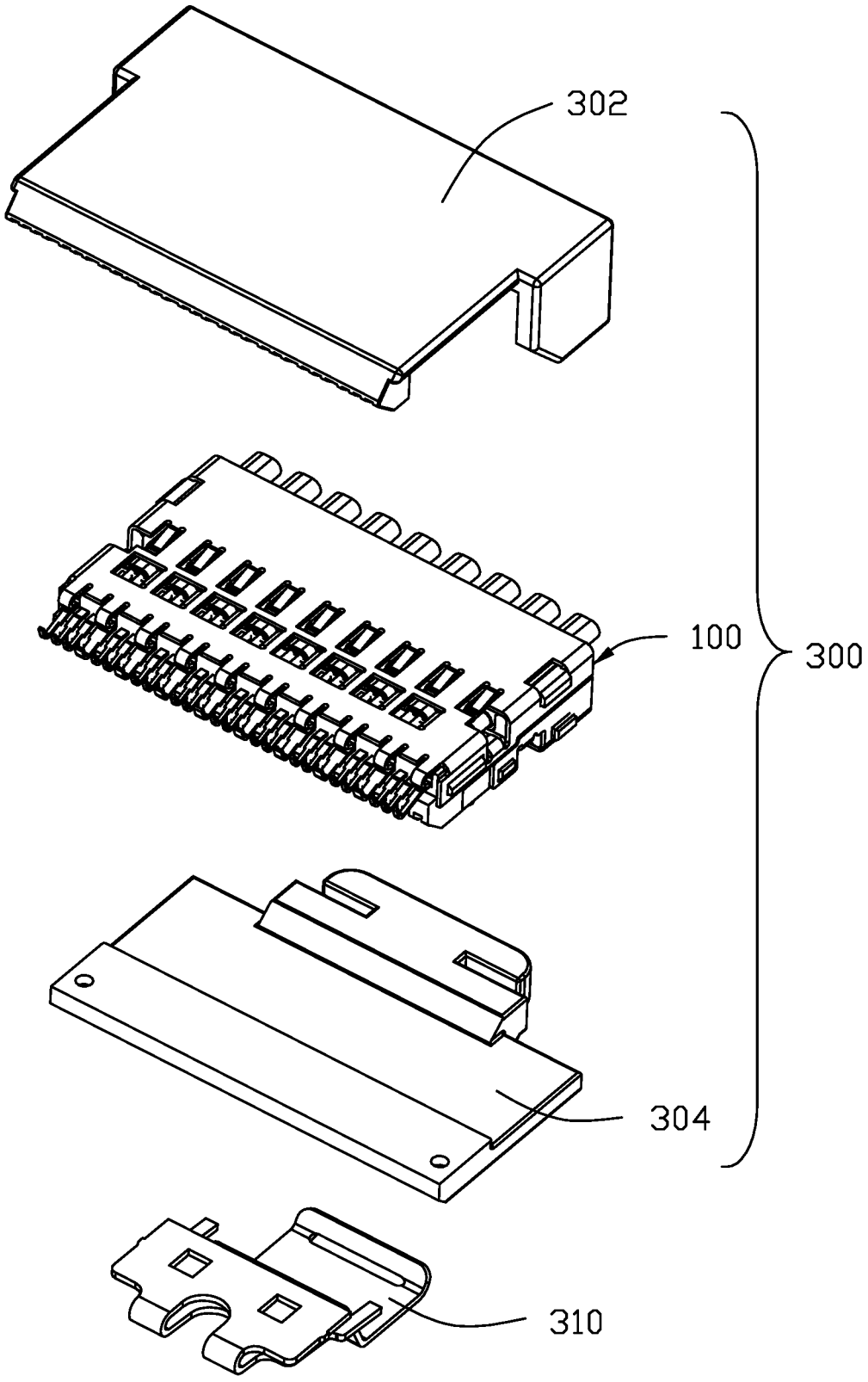
FIG. 4(A) is a further perspective view of the electrical connector of FIG. 3.
Figure 4B:
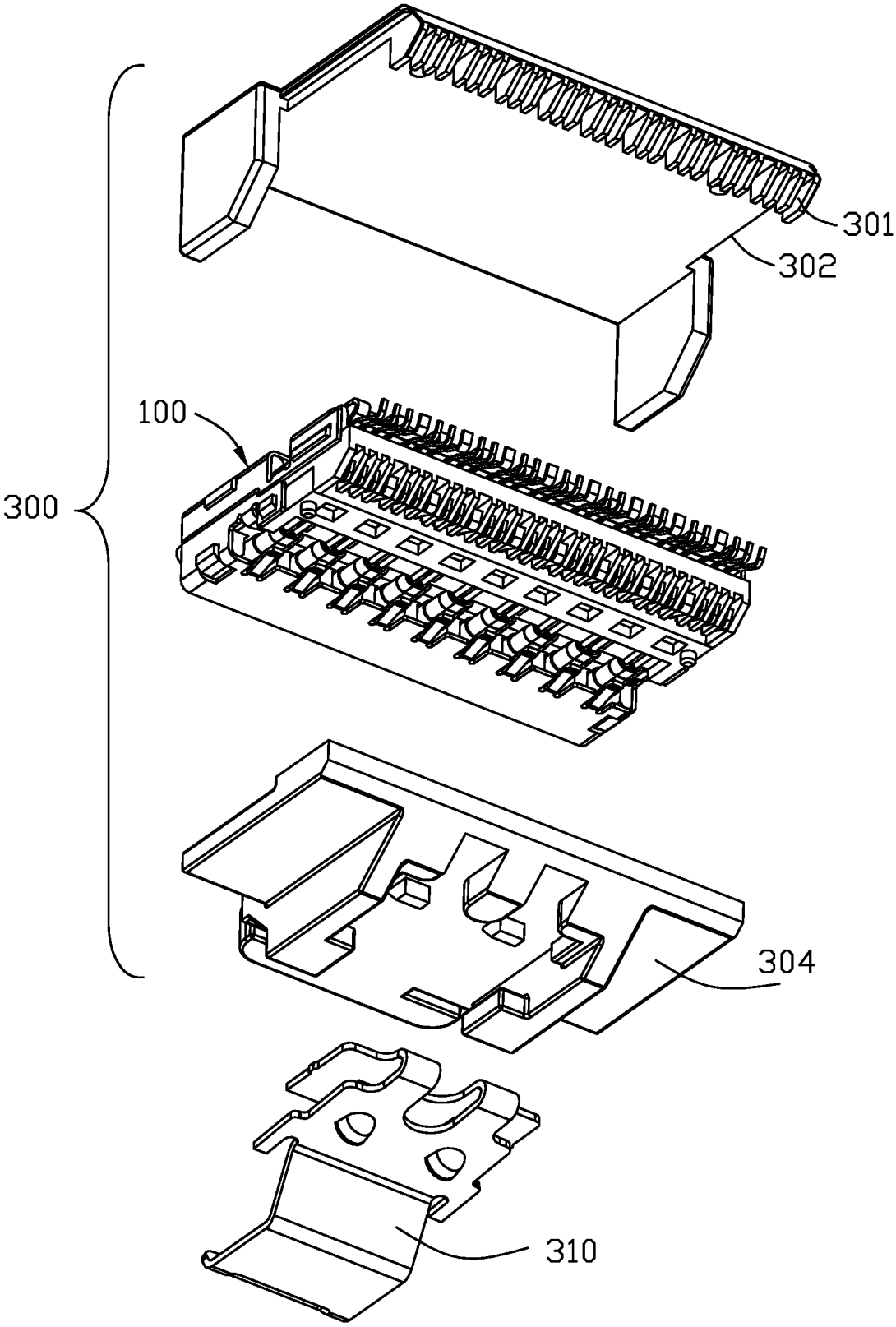
FIG. 4(B) is another exploded perspective view of the electrical connector of FIG. 4(A)
Figure 4C:
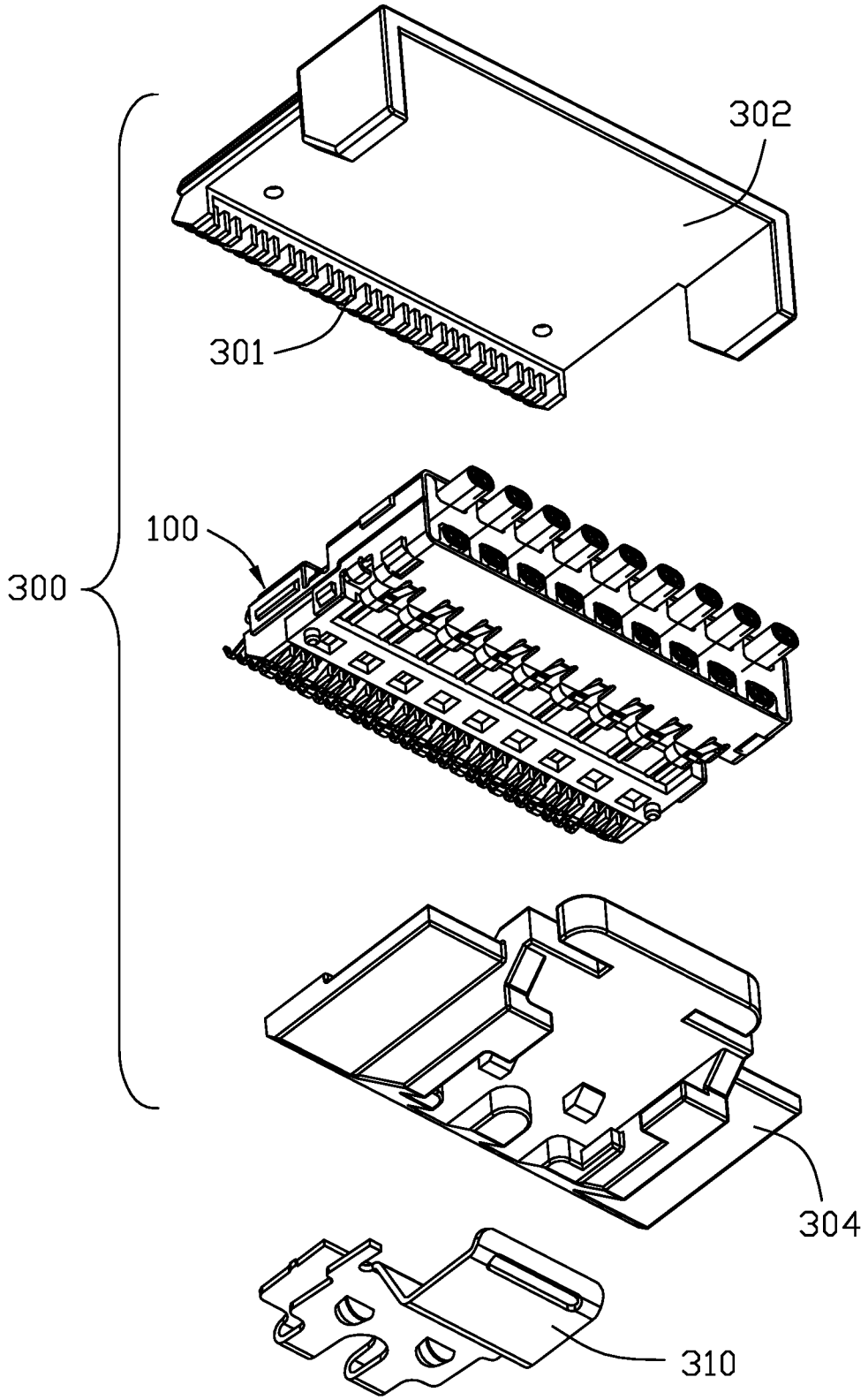
FIG. 4(C) is another exploded perspective view of the electrical connector of FIG. 4(A)
Figure 5A:
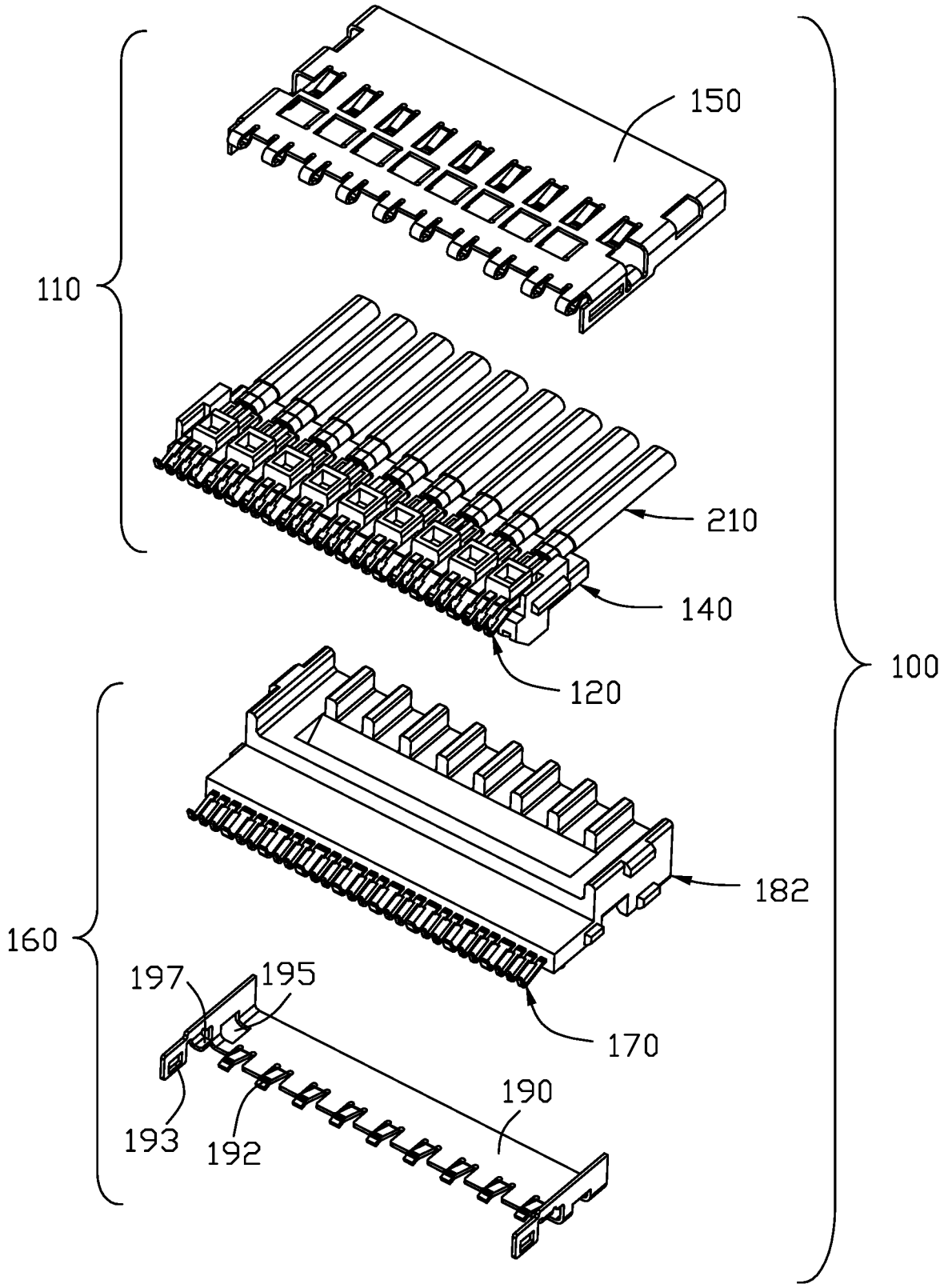
FIG. 5(A) is an exploded perspective view of the contact module of the electrical connector of FIG. 4(A)
Figure 5B:
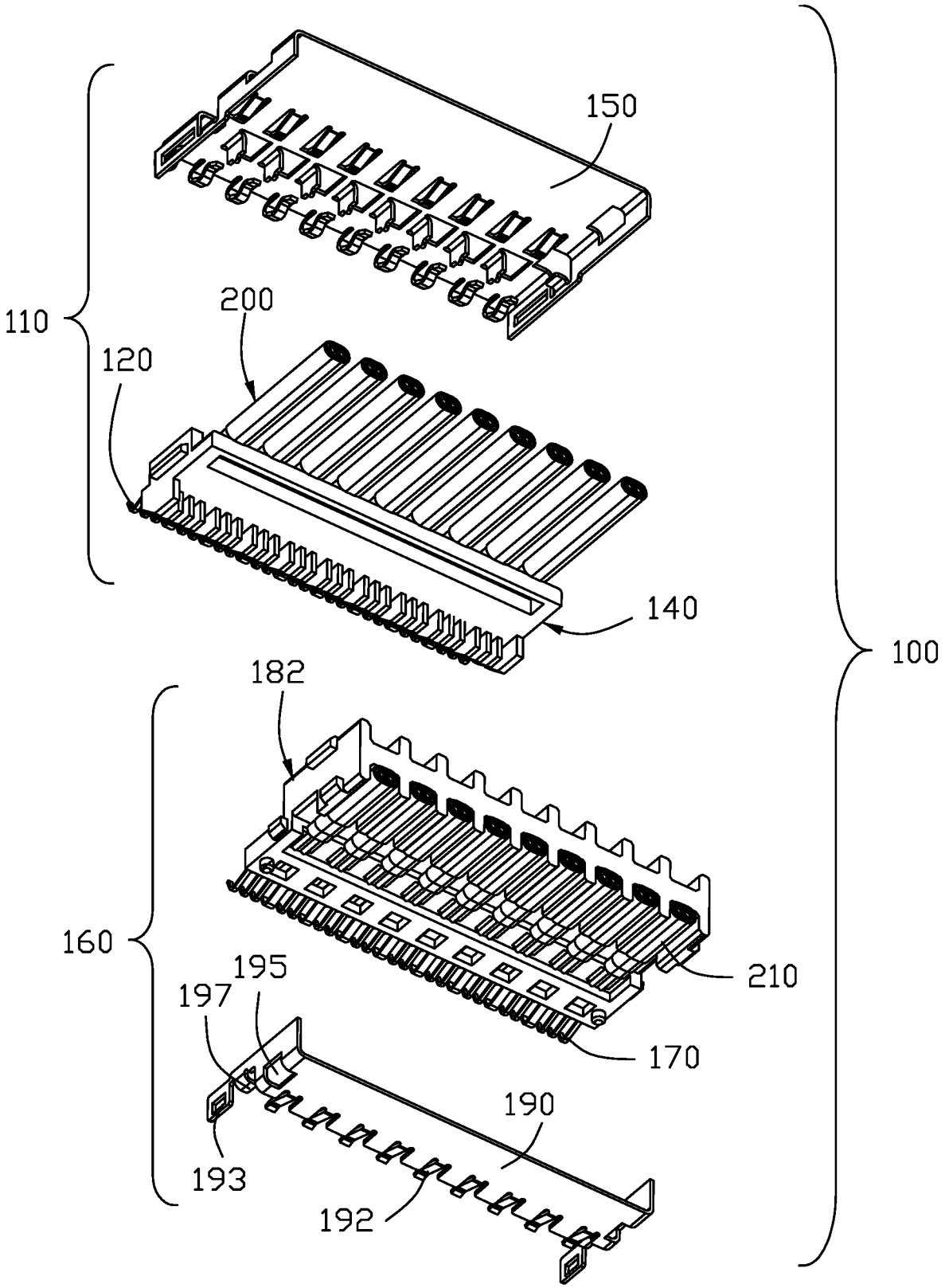
FIG. 5(B) is another exploded perspective view of the electrical connector of FIG. 5(A)
Figure 6A:
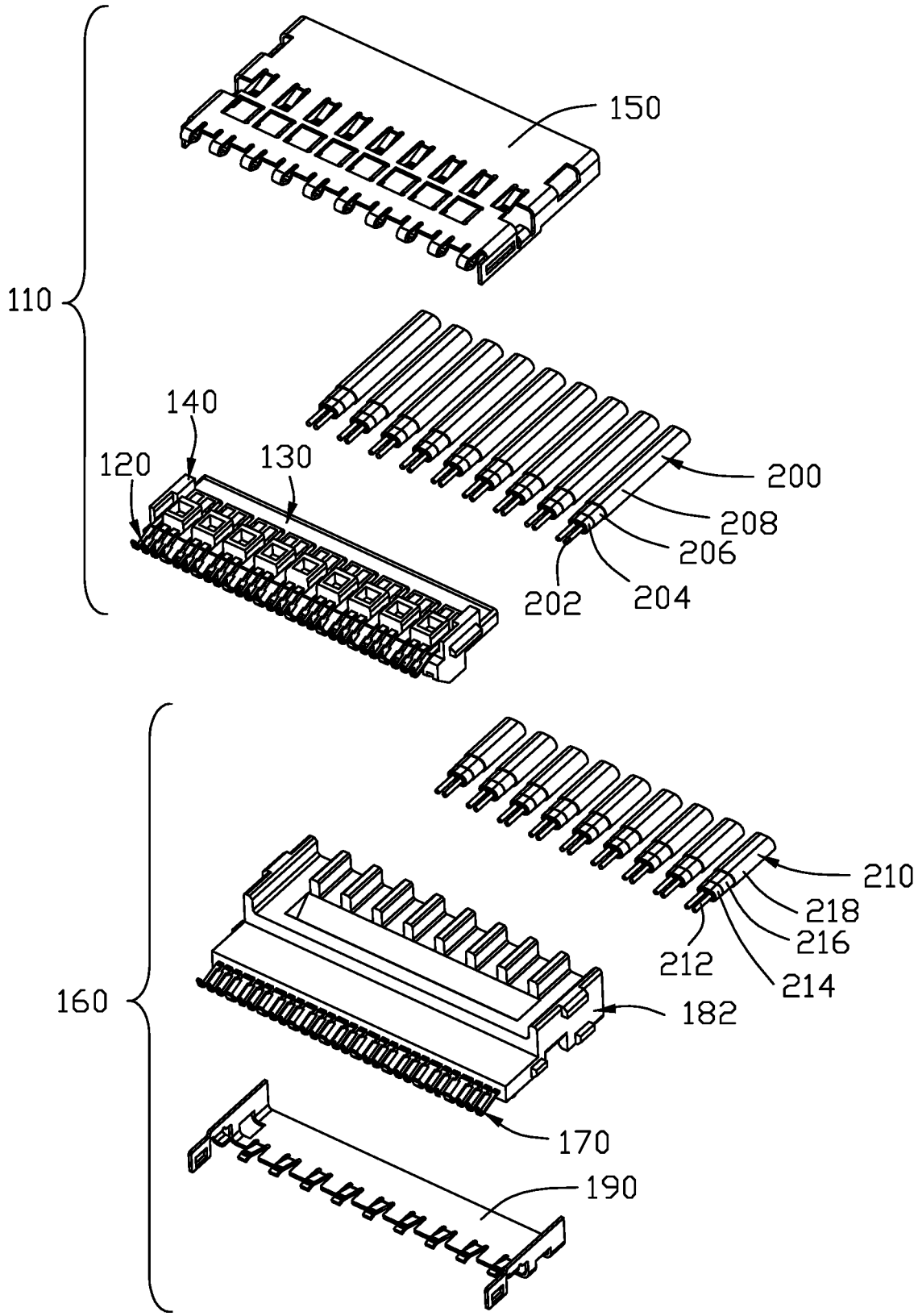
FIG. 6(A) is a further exploded perspective view of the contact module of the electrical connector of FIG. 5(A)
Figure 6B:
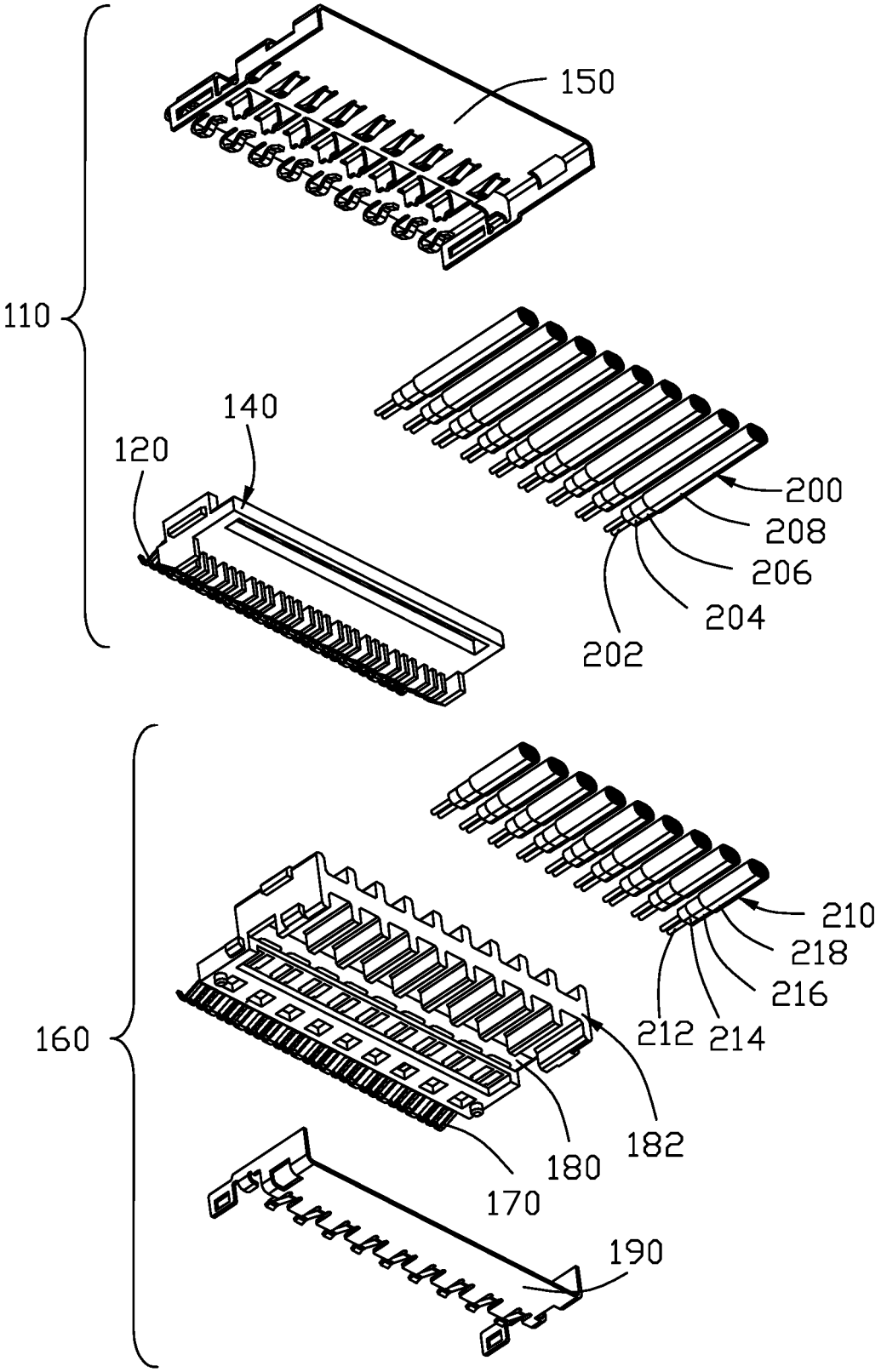
FIG. 6(B) is another exploded perspective view of the contact module of the electrical connector of FIG. 6(A)
Figure 7A:
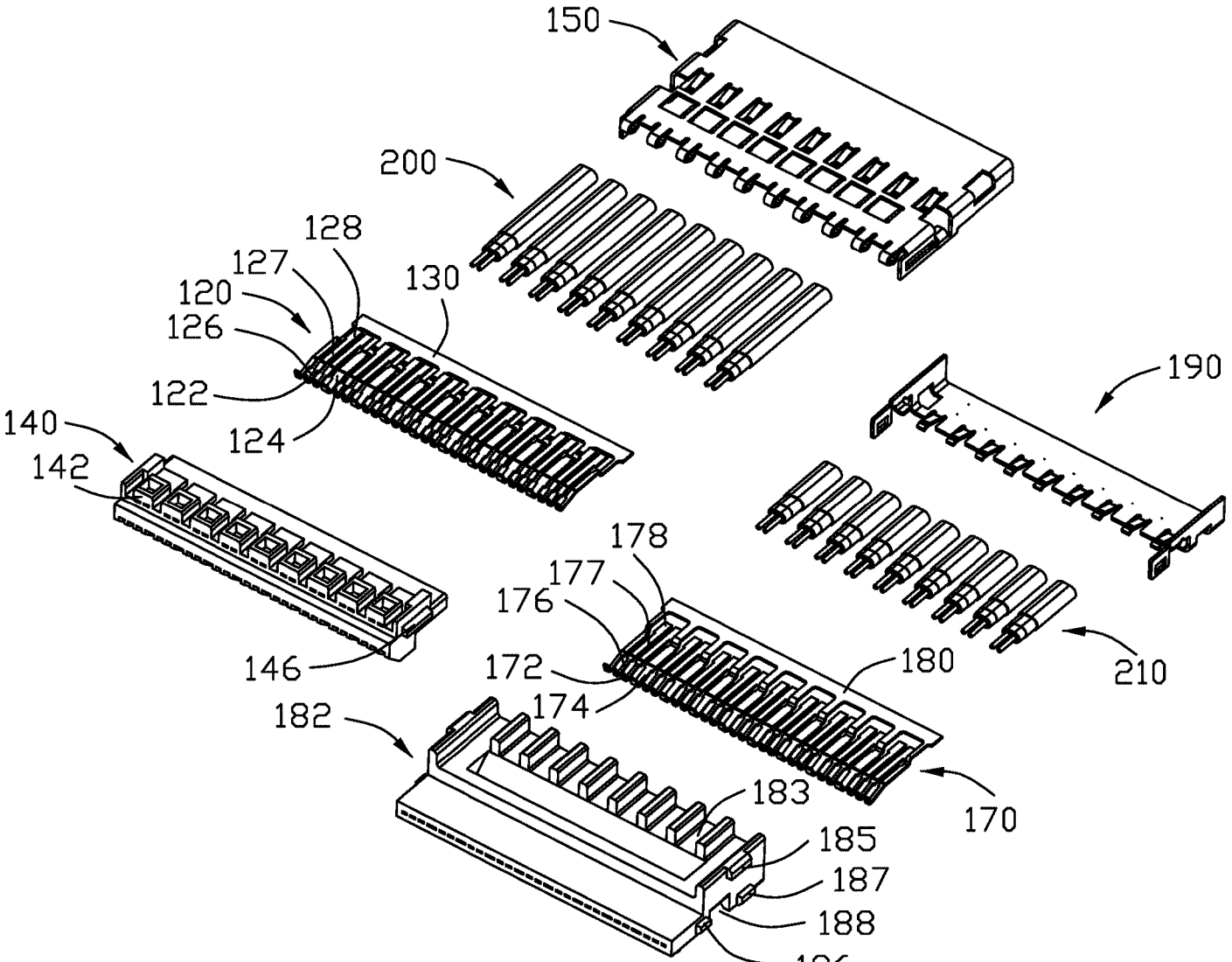
FIG. 7(A) is a further exploded perspective view of the contact module of the electrical connector of FIG. 6(A)
Figure 7B:
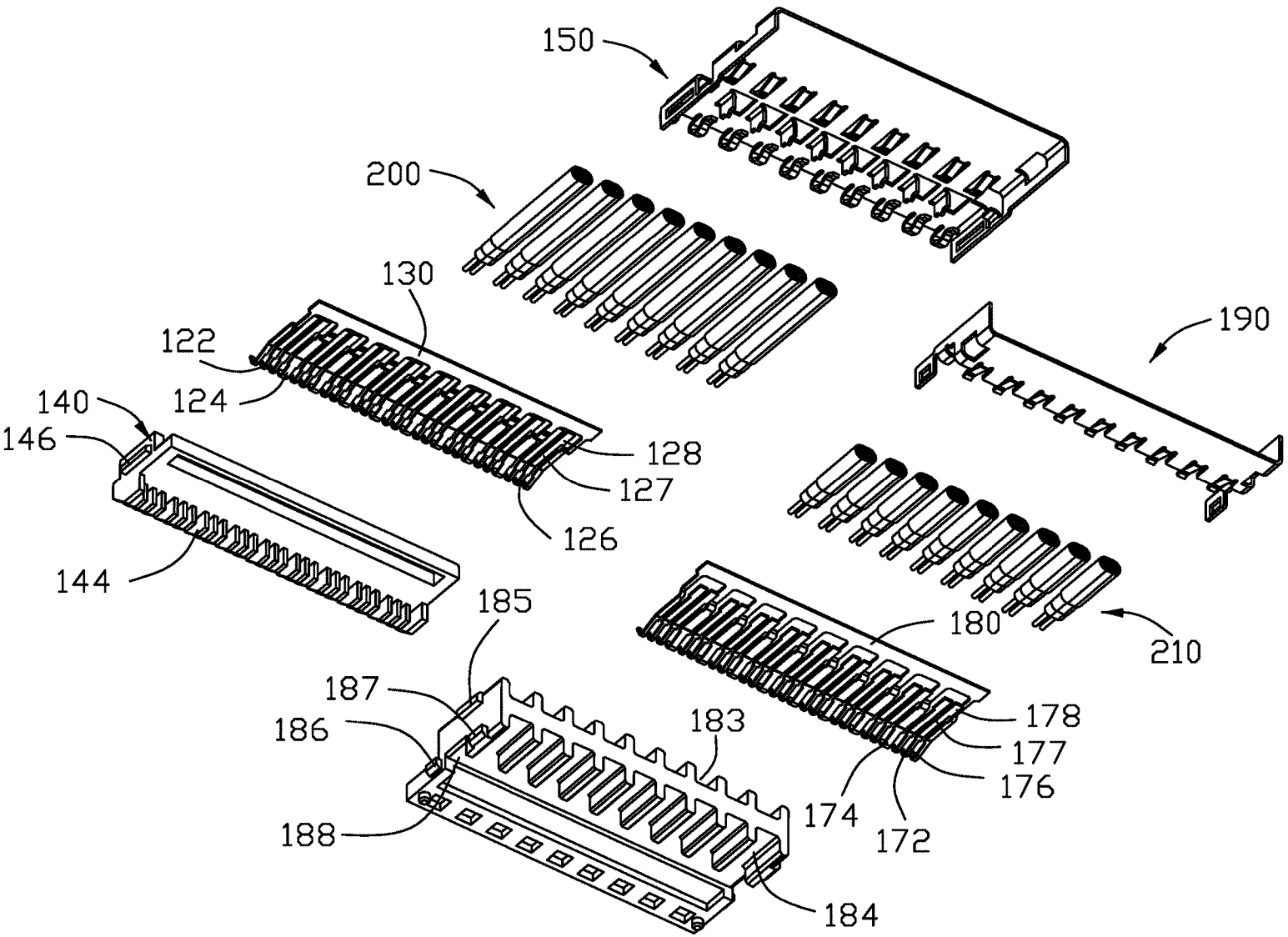
FIG. 7(B) is another exploded perspective view of the contact module of the electrical connector of FIG. 7(A)
Figure 8A:
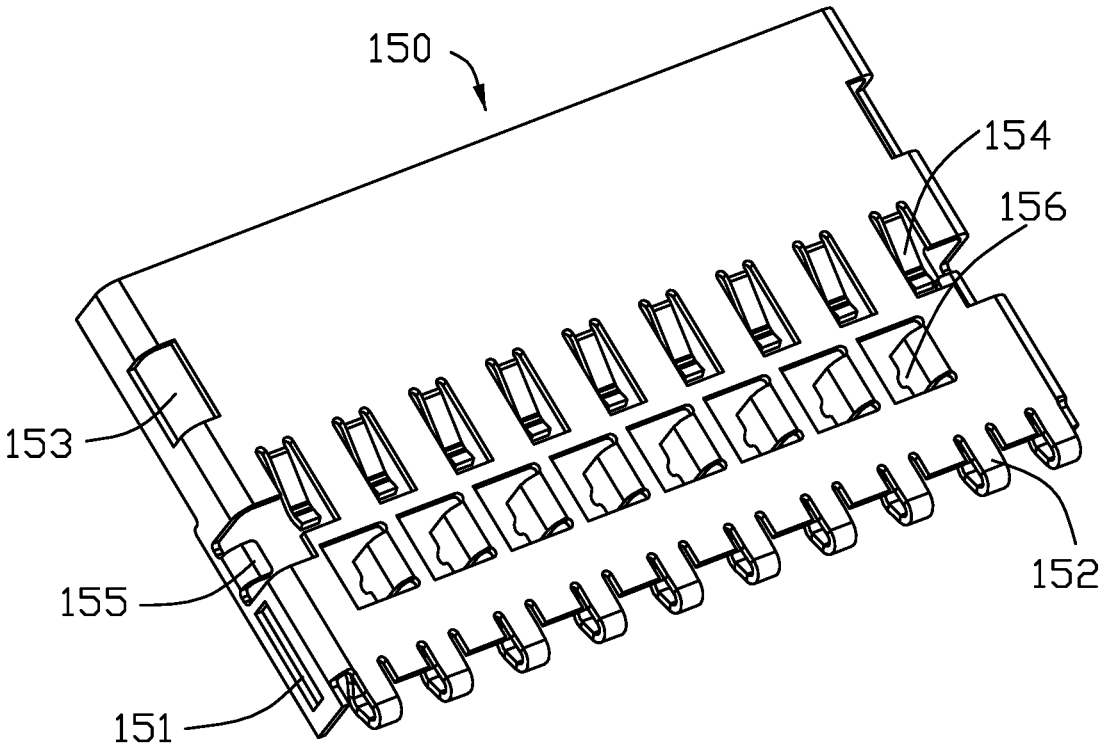
FIG. 8(A) is a perspective view of the upper shield of the upper part of the contact module of the electrical connector of FIG. 7(A)
Figure 8B:
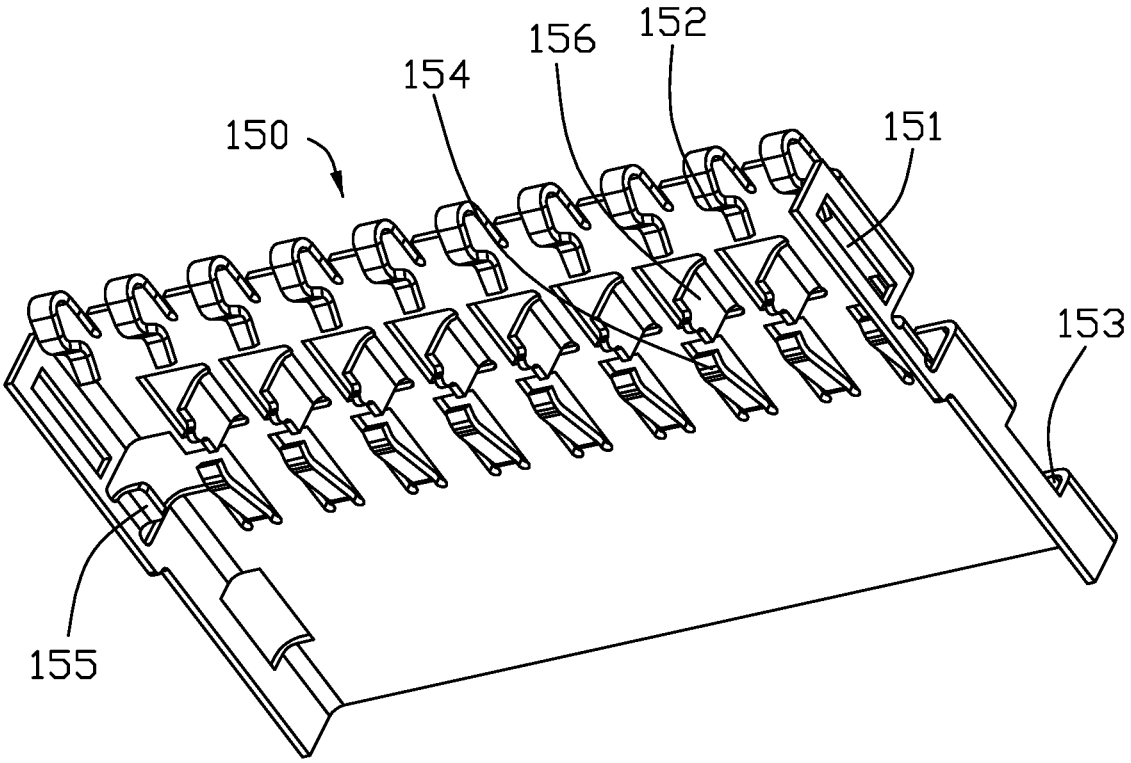
FIG. 8(B) is another exploded perspective view of the upper shield of the upper part of the contact module of the electrical connector of FIG. 8(A)
Figure 9A:
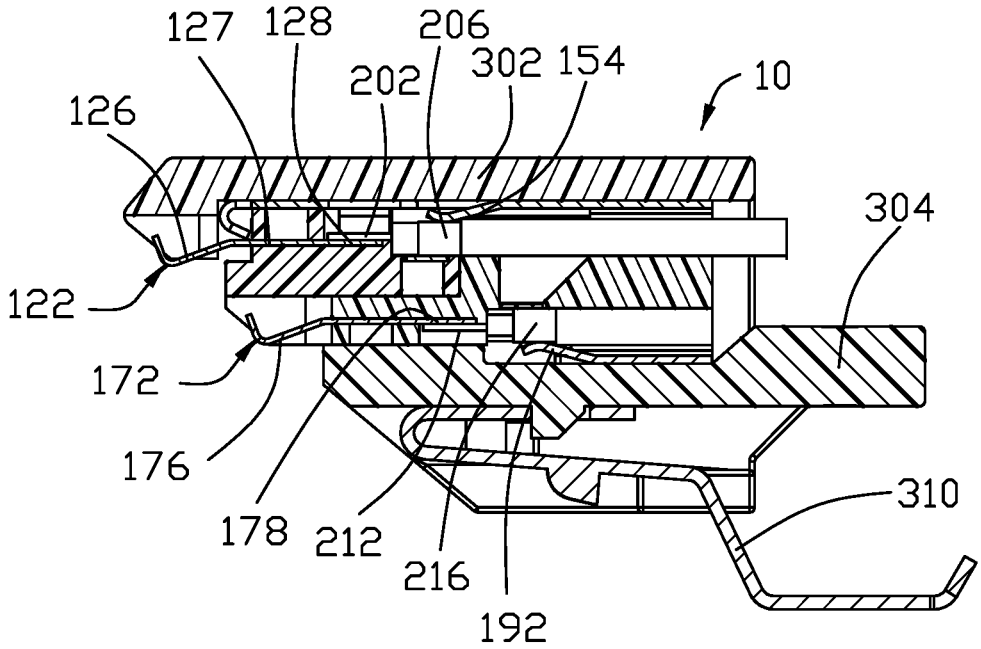
FIG. 9(A) is a cross-sectional view of the electrical connector of FIG. 1(A) to show the differential-pair signal contacts.
Figure 9B:
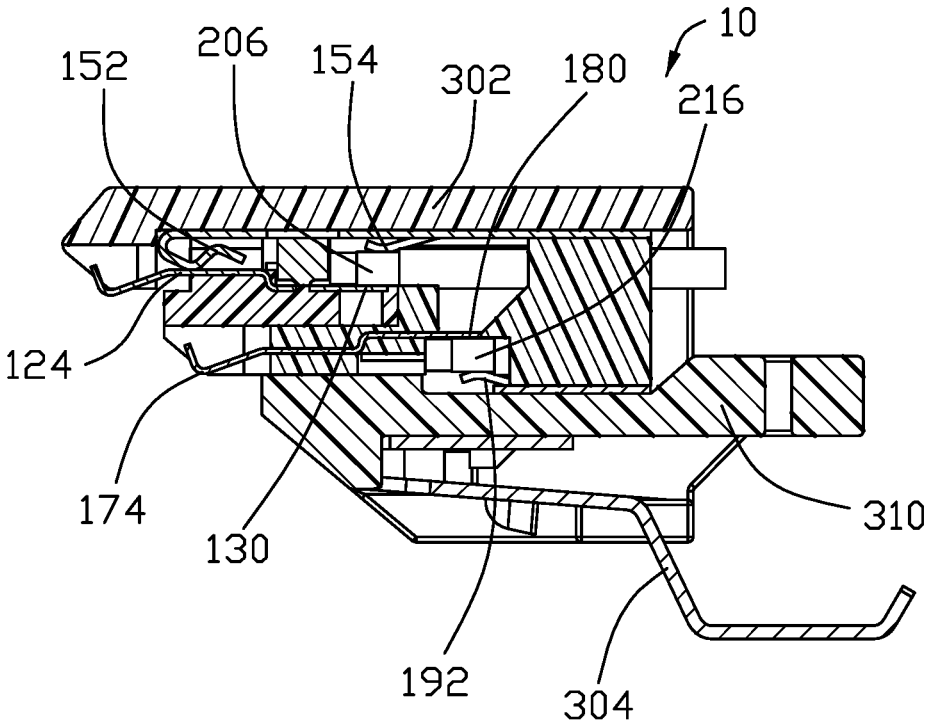
FIG. 9(B) is another cross-sectional view of the electrical connector of FIG. 1(A) to show the grounding contacts.

Referring to FIGS. 1-9(B), a cable connector 10 connecting with a plurality of wires for mating with a receptacle connector (not shown), includes a contact module 100 enclosed within a case 300. The contact module 100 includes an upper/first part 110 and a lower/second part 160 stacked with each other.

The upper part 110 includes a plurality of upper contacts 120 integrally formed within an upper insulator 140 via insert-molding, and a metallic upper shield 150 attached upon the upper insulator 110. The upper contacts 120 include a plurality of differential-pair signal contacts 122 and grounding contacts 124 alternately arranged with each other along the transverse direction. Each upper contact 120 includes a deflectable front mating section 126 for mating with a circuit pad (not shown) located on the printed circuit board (not shown) and enclosed within the receptacle connector (not shown), a rear connecting section 128 for connecting to the corresponding upper wire 200, and a middle retaining section 127 therebetween. Rear ends of the connecting sections 128 are unified together via a transversely extending grounding bar 130. Correspondingly, each of the upper wires 200 includes a pair of inner conductors 202 enclosed within an inner insulative layer 204 which is further enclosed within a metallic braiding layer 206, and an outer insulative jacket 208 encloses the braiding layer 206, wherein the inner conductors 202 are mechanically and electrically connected to the connecting sections 128 of the differential-pair signal contacts 122, and the braiding layer 206 is mechanically and electrically connected to the grounding bar 130. Notably, the connecting section 128 and the middle retaining section 127 are coplanar with each other while the grounding bar 130 is offset from the connecting section 128 so as to comply with the structural relationship between the inner connector 2202 and the braiding layer 206.

The upper insulator 140 forms a plurality of hollow standoffs 142 in alignment with the middle retaining sections 127 of the corresponding differential-pair signal contacts 122 in the vertical direction to support the upper shield 150 while exposing the middle retaining sections 127 toward the upper shield 150 in the vertical direction for electrical consideration. A plurality of grooves 144 are formed in an underside of the upper insulator 140 for receiving the lower contacts of the lower part 160 (illustrated later). A pair of protrusions 146 are formed on two opposite sides for securing the upper shield 150.

The upper shield 150 includes a row of front spring fingers 152 downwardly abutting against the retaining sections 127 of the grounding contacts 124 of the upper contacts 120, respectively, a row of rear spring fingers 154 downwardly respectively abutting against the braiding layers 206 of the wires 200 for cooperating with the grounding bar 130 to sandwich the braiding layers 206 therebetween in the vertical direction, and a row of middle dividing tabs 156 to separate the connecting sections 128 of the neighboring differential-pair signal contacts 122 from one another, wherein the front spring fingers 152 are aligned with the corresponding middle tabs 156 in the front-to-back direction, respectively, while are offset from the corresponding rear spring fingers 154 in the transverse direction, respectively. The upper shield 150 further includes a pair of front openings 151 receive the corresponding protrusions 146 for securing the upper shield 150 upon the upper insulator 140, a pair of rear openings 153 and a pair of securing tabs 155.

Correspondingly, the lower part 160 includes a plurality of lower contacts 170 integrally formed within a lower insulator 182 via insert-molding, and a metallic lower shield 190 attached upon the lower insulator 182. The lower contacts 170 include a plurality of differential-pair signal contacts 172 and a plurality of grounding contacts 174 alternatively arranged with each other along the transverse direction. Each of the lower contacts 170 includes a front mating section 176, a rear connecting section 178 and a middle retaining section 177 wherein the mating sections 176 are partially received within the corresponding grooves 144 on the upper insulator 140. Similar to the upper contacts 120, the rear connecting sections 178 of the grounding contacts 174 are joined together via a transverse grounding bar 180. Similar to the upper wires 200, each of the lower wires 210 includes an inner conductor 212, an inner insulative layer 214, a metallic braiding layer 216 and an outer insulative jacket 218. The inner conductors 212 of the lower wires 210 are mechanically and electrically connected to the connecting sections 178 of the corresponding differential-pair signal contacts 172, and the braiding layers 216 are mechanically and electrically connected to the grounding bar 180.

The lower insulator 182 forms a row of upper grooves 183 to respectively receive the corresponding upper wires 200, and a row of lower grooves 184 to respectively receive the corresponding lower wires 210. The lower insulator 182 further includes a pair of upper protrusions 185 to be received within the corresponding rear openings 153, a pair of first lower protrusions 186, a pair of second lower protrusions 187, and a pair of cutouts 188.

The lower shield 190 includes a row of spring fingers 192 respectively abutting against the braiding layers 216 of the corresponding lower wires 210 so as to cooperate with the grounding bar 180 to sandwich such braiding layers 216 therebetween in the vertical direction, a pair of front openings 193 receiving the corresponding first lower protrusions 186, a pair of rear openings 195 receiving the corresponding second lower protrusions 187, and a pair of securing tabs 197 secured into the corresponding cutouts 188.

The case 300 includes an upper piece 302 and a lower piece 304 commonly sandwiching the contact module 100 therebetween wherein the upper piece 302 forms a plurality of grooves 301 to receive the mating sections 126 of the upper contacts 120 respectively, and the lower piece 304 is equipped with a deflectable latch 310 so as to be engaged with the housing of the complementary receptacle connector (not shown).

The feature of the invention is to provide the metallic shield with a plurality of spring fingers respectively contacting the grounding contacts and the braiding layers of the wires, and a plurality of dividing tabs to separate the neighboring differential-pair signal contacts. Therefore, the metallic shield is essentially. Another feature of the invention is to provide the plug/cable connector mated with the receptacle connector on the printed circuit board in an oblique manner wherein the latch is protectively hidden on an underside of the connector assembly. Correspondingly, the front face of the connector extends in an oblique direction to allow the cable connector 10 mateable upon the printed circuit board in the oblique manner.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. A cable connector comprising:

a case; and a contact module enclosed within the case and comprising an upper part and a lower part stacked with each other, the upper part including:

a plurality of upper contacts integrally formed within an upper insulator via insert-molding, the upper contacts comprising a plurality of differential-pair signal contacts and a plurality of grounding contacts alternately arranged with each other in a transverse direction, each of the upper contacts comprising a front mating section, a rear connecting section, and a middle retaining section therebetween in a front-to-back direction;

a plurality of upper wires located behind the upper insulator, each of the upper wire comprising a pair of inner conductor, an inner insulative layer, a metallic braiding layer, and an outer insulative jacket sequentially enclosing one another, the inner conductors of the wires mechanically and electrically connected respectively to the connecting sections of the differential-pair signal contacts; and a metallic upper shield secured to the upper insulator, the metallic upper shield including a plurality of front spring fingers respectively contacting corresponding grounding contacts of the upper contacts and a plurality of rear spring fingers respectively contacting the braiding layers of corresponding wires.

2. The cable connector as claimed in claim 1, further comprising an upper grounding bar extending along the transverse direction, and wherein rear ends of the connecting sections of the grounding contacts are unitarily connected to the upper grounding bar, and the braiding layers of the wires are mechanically and electrically connected respectively to the upper grounding bar.

3. The cable connector as claimed in claim 1, wherein each of the front spring fingers abuts against the retaining section of a corresponding grounding contact of the upper contact.

4. The cable connector as claimed in claim 1, wherein the braiding layers of the upper wires are secured to the upper grounding bar via solder.

5. The cable connector as claimed in claim 1, wherein the front spring fingers are respectively offset from the corresponding rear spring fingers in a transverse direction.

6. The cable connector as claimed in claim 1, wherein the retaining section and the connecting section of each upper contact are coplanar with each other while the upper grounding bar is offset from the retaining section and the connecting section in a vertical direction.

7. The cable connector as claimed in claim 1, wherein the upper insulator forms a plurality of hollow standoffs respectively aligned with the middle retaining sections of the corresponding differential-pair signal contacts in a vertical direction so as to expose the middle retaining sections of the corresponding differential-pair signal contacts toward the upper shield.

8. The cable connector as claimed in claim 1, wherein the upper shield comprises a plurality of dividing tabs located between the front spring fingers and the rear spring fingers in a front-to-back direction, and alternately arranged with the connecting sections of the differential-pair signal contacts in the transverse direction so as to separate the connecting sections of the neighboring differential-pair signal contacts in the transverse direction.

9. The cable connector as claimed in claim 8, wherein the dividing tabs are respectively aligned with the front spring fingers in the front-to-back direction.

10. The cable connector as claimed in claim 1, wherein the lower part comprises a plurality of lower contacts integrally formed within a lower insulator via insert-molding, and a metallic lower shield secured to an underside of the lower insulator, each of the lower contacts comprises a front mating section, a rear connecting section, and a middle retaining section, and the upper insulator forms a plurality of grooves in an underside thereof to receive the mating sections of the corresponding lower contacts, respectively.

11. The cable connector as claimed in claim 10, wherein a plurality of lower wires are located behind the lower insulator, each of the lower wires includes a pair of inner conductor, an inner insulator, a metallic braiding layer, and an outer insulative jacket, the inner conductor is connected to the connecting section of the corresponding lower contact, and the lower shield forms a plurality of spring fingers respectively contacting the braiding layers of the lower wires.

12. The cable connector as claimed in claim 11, wherein the case comprises an upper piece located upon the upper shield and forming a plurality of grooves to receive the mating sections of the upper contacts, respectively.

13. The cable connector as claimed in claim 12, wherein the case further comprises a lower piece located on an underside of the lower shield and has a deflectable latch on an underside thereof.

14. A cable connector for use in an oblique manner, comprising:

a contact module enclosed within a case;

the contact module defining an oblique front face and comprising an upper part and a lower part stacked with each other;

the upper part comprising a plurality of upper contacts retained with an upper insulator and a plurality of upper wires located behind the upper insulator and respectively connected to the corresponding upper contacts;

the lower part comprising a plurality of lower contacts retained with a lower insulator and a plurality of lower wires located behind the lower insulator and respectively connected to the corresponding lower contacts;

wherein the case is equipped with a deflectable latch on an underside thereof in a protective manner so as to have the deflectable latch closer to the lower part than to the upper part.

15. The cable connector as claimed in claim 14, wherein the upper insulator forms a plurality of grooves to receive front mating sections of the lower contacts.

16. The cable connector as claimed in claim 14, wherein the case forms a plurality of grooves to receiver front mating sections of the upper contacts.

17. The cable connector as claimed in claim 14, wherein the lower insulator forms a plurality of upper grooves to respectively receive the corresponding upper wires, and a plurality of lower grooves to respectively receive the corresponding lower wires.

18. A cable connector comprising:

a contact module enclosed within a case and comprising a first part and a second part stacked with each other;

each of the first and second parts comprising a row of contacts integrally formed within an insulator, a plurality of wires, and a metallic shield attached to the insulator;

each row of contacts comprising a plurality of differential-pair signal contacts and a plurality of grounding contacts alternately arranged with each other, each of the contacts comprising a front mating section, a rear connecting section, and a middle retaining section therebetween in a front-to-back direction;

each of the wires comprising an inner conductor, an inner insulative layer, a metallic braiding layer, and an outer insulative jacket sequentially enclosing one another, the inner conductors of the wires mechanically and electrically connected respectively to the connecting sections of the differential-pair signal contacts;

each metallic shield having a plurality of front spring fingers respectively contacting corresponding grounding contacts of each row of contacts;

wherein the metallic shield of the first part comprises a plurality of rear spring fingers respectively contacting the braiding layers of the corresponding wires.

19. The cable connector as claimed in claim 18, wherein the case is equipped with a deflectable latch on an underside thereof in a protective manner so that the deflectable latch is closer to the second part than to the first part.

20. The cable connector as claimed in claim 18, wherein the contact module defines an oblique front face, and the second part is located behind the first part.

* * * * *